United States Patent [19]

Matthews et al.

[11] Patent Number: 4,938,114

[45] Date of Patent: Jul. 3, 1990

[54] MINE CLEARING APPARATUS

[75] Inventors: John D. Matthews, Simi Valley; Donald E. Williams, Oxnard, both of Calif.

[73] Assignee: The United States of America as represented by the Secretary of the Navy, Washington, D.C.

[21] Appl. No.: 415,760

[22] Filed: Oct. 2, 1989

[51] Int. Cl.[5] ..... F41H 11/12

[52] U.S. Cl. ..... 89/1.13; 172/832

[58] Field of Search ..... 172/239, 832, 387, 4; 89/1.13

[56] References Cited

U.S. PATENT DOCUMENTS

| | | | |
|---|---|---|---|
| 2,008,908 | 7/1935 | Gustafson | 172/832 |
| 2,900,931 | 8/1959 | Lisle | 172/413 |
| 2,933,838 | 4/1960 | Rockwell | 172/832 |
| 3,005,275 | 10/1961 | Febre | 172/239 |
| 4,064,945 | 12/1977 | Haney | 172/4 |
| 4,102,403 | 7/1978 | Steinberg | 172/40 |
| 4,194,573 | 3/1980 | Rettkowski | 172/400 |
| 4,491,053 | 1/1985 | Bar-Nefy et al. | 89/1.13 |
| 4,552,053 | 11/1985 | Bar-Nefy et al. | 89/1.13 |
| 4,590,844 | 5/1986 | Bar-Nefy et al. | 89/1.13 |
| 4,690,030 | 9/1987 | Bar-Nefy et al. | 89/1.13 |
| 4,727,940 | 3/1988 | Bar-Nefy et al. | 172/4 |

FOREIGN PATENT DOCUMENTS

| | | | |
|---|---|---|---|
| 682611 | 8/1979 | U.S.S.R. | 172/832 |

*Primary Examiner*—David H. Brown

*Attorney, Agent, or Firm*—David S. Kalmbaugh

[57] ABSTRACT

Plowing means for dislodging, uplifting and sweeping aside mines are attached to a crossbeam and located on either side of float shoes that slide along the ground and adjust to maintain a chosen depth of plow. The crossbeam is connected to the front of a vehicle by pushbars that attach to a frame mounting on the vehicle. The float shoes are caused to move by powered adjusting means mounted on the crossbeam and controlled by sensing means that monitor the attitude of the vehicle relative to the pushbars and generate a control signal for maintaining the plow depth.

6 Claims, 4 Drawing Sheets

MINE CLEARING APPARATUS

BACKGROUND OF INVENTION

Todays modernized tanks, like the 100,000 pound, 800 horsepower U. S. M60, represent an awesome configuration of destructive power. However, this goliath can be easily disabled by the simple yet effective land mine. Various systems have been developed to detect and remove land mines, one of which is a plow type device mounted to the front of the tank and pushed through the soil to uproot and sweep aside an impending mine. These mine plows have been effective when utilized with powerful, heavy vehicles since the power and tractive effort are available to propel the plow through "tough" spots such as roots or clay or uneven terrain. These plows are also effective when plowing through relatively soft and consistent soils which require less power and tractive effort. However, when utilized on a light vehicle such as an assault amphibian vehicle (AAV), with limited tractive effort or when plowing through tough and inconsistent soils, prior art mine plows bog down and stop the plowing vehicle dead in its tracks. This is wholly inconsistent with battlefield tactics and can result in loss of both life and vehicle.

It was discovered that traction and horsepower were limiting factors and that plowing devices could operate satisfactorily on lighter, less powerful vehicles if the plowing depth could be maintained at a constant depth. The force required to propel a plow through the soil varies by the square of its depth in the soil. When a particularly "tough" spot was encountered, a plow would dig deeper into the soil placing a premium on tractive effort and power to overcome this "tough" spot. Bogging down was rarely a problem on the powerful, heavy M60 tank because the power and weight (i.e. tractive effort) were usually sufficient to maintain the desired depth of plow. However, when adapting the plow to lighter, less powerful vehicles such as the 50,000 pound, 400 horsepower AAV, the bogging down problem became acute at the required depth of plow (usually 8–12 inches). The reactive force from the plow would cause the front of the light plowing vehicle to raise up and thereby rotate the tips of the tines deeper into the soil effecting a deeper depth of cut.

Attempts have been made to overcome some of the deficiencies associated with prior art plows.

U.S. Pat. No. 4,491,053 to Bar Nefy et al discloses a mechanism for raising a mine plow while backing the vehicle and for preventing a deeper depth of cut while plowing.

U.S. Pat. No. 4,552,053 to Bar Nefy et al discloses a ground sensing means attached to the vehicle and a positioning means that function together to change the plowing depth from a location inside the vehicle.

U.S. Pat. No. 3,005,275 to Febre discloses a mechanical linkage system that automatically lifts the plowing blade of a tractor in response to forces acting on the plow blade.

U.S. Pat. No. 4,064,945 to Havey discloses an electronic control system which senses a plurality of transducers and produces a control signal to operate a control device.

U. S. Pat. No. 4,194,573 to Rettkowski discloses a pulled agricultural implements for breaking subsoil and a hydraulic system for raising the implements out of the soil for transportation on a highway.

However, none of these systems provide a simple, reliable, battle worthy mine plow that will operate on a light, traction limited vehicle to maintain a constant depth of plow when pushed by the front of the vehicle.

SUMMARY OF THE INVENTION

The present invention seeks to overcome the difficulties and disadvantages described in the aforementioned prior art devices.

As such, the present invention provides an improved mine clearing apparatus for maintaining a constant depth of plow when pushed from the front of a relatively light modestly powered vehicle, such as an AAV, and that is simple, reliable and battle tough.

In accordance with the present invention, there is provided mine clearing apparatus comprising a front mount assembly that attaches to available mounts located on the front of the propelling vehicle, the front mount assembly providing selectable locations for attachment of pushbars that communicate with the crossbeam assembly of the mine clearing apparatus.

There are also provided plowing assemblies attached to the ends of the crossbeam assembly, each plowing assembly including a plurality of parallel, forward facing horizontally disposed tines for engaging the soil to a desired depth and for dislodging and uplifting soil and mines to be swept aside by rearwardly positioned, concave moldboards.

Further, there is provided a float shoe assembly attached to the crossbeam assembly for selectively positioning the plowing assemblies relative to the ground surface, the float shoe assembly including a pair of parallel float shoes that slide along virgin ground and are attached to the crossbeam assembly by arms that pivot in response to the input from the adjuster assembly to position the plowing tines relative to the ground surface. The float shoes slide on virgin soil and are not impacted by the trench created by the plowing assemblies.

There is also provided a sensor to monitor the position of the mine clearing apparatus relative to the AAV and to produce control signals to operate the depth adjuster assembly to maintain a constant plow depth when, for example, the AAV raises up in response to changing soils, when plowing on other than level ground or when encountering bumpy terrain.

DETAILED DESCRIPTION OF THE INVENTION

Figure 1:
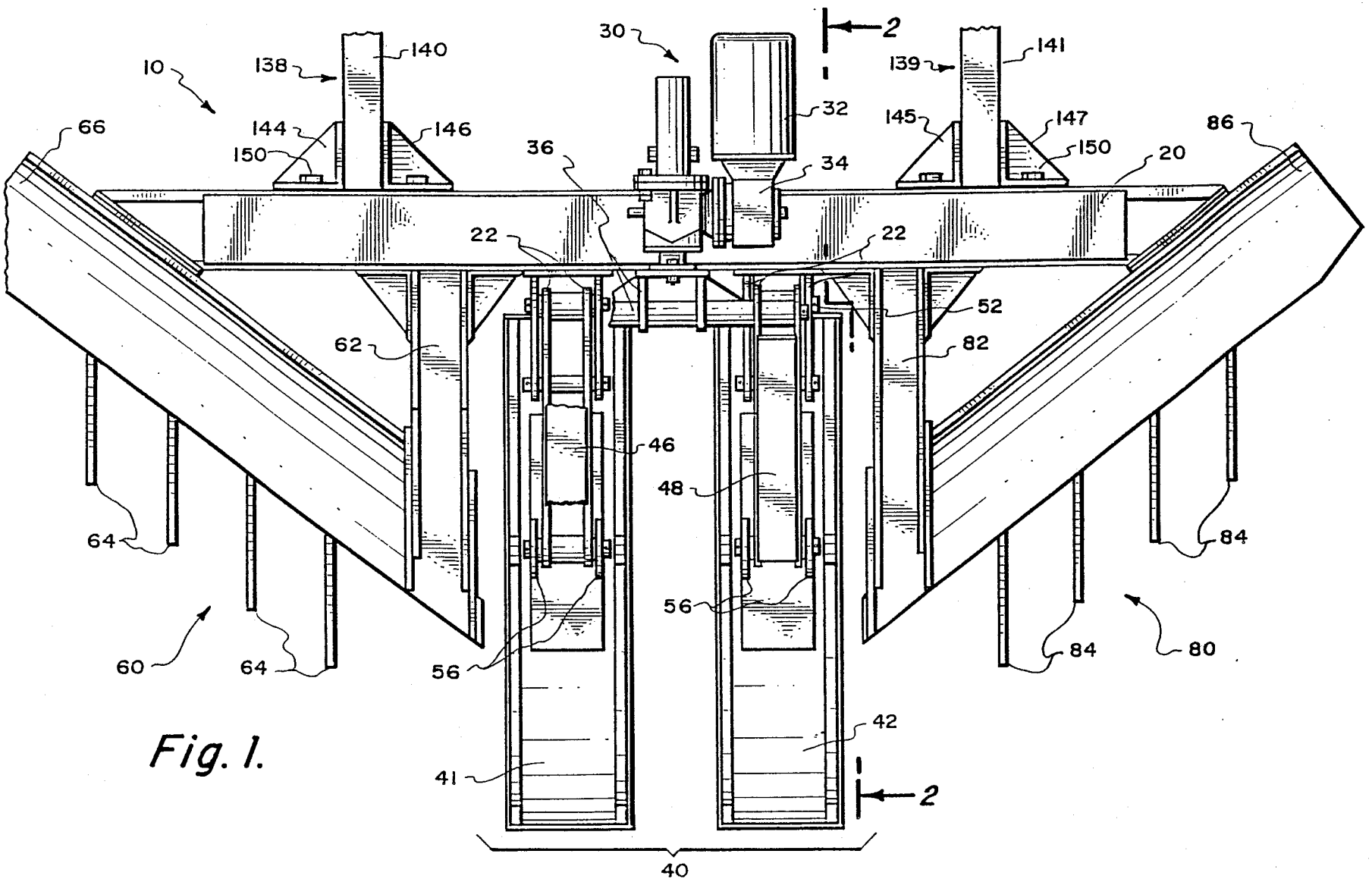
FIG. 1 shows a top view of the mine clearing apparatus of the present invention.

In general, as shown in FIG. 1, mine clearing apparatus 10 of the present invention includes plowing assemblies 60 and 80 angularly attached to the ends of crossbeam assembly 20; float shoe assembly 40 attached to crossbeam 20 and located between and forwardly of plowing assemblies 60 and 80; depth adjuster 30 located rearwardly of float shoe assembly 40 and attached to cross beam 20; pushbars 138 and 139 (shown in FIGS. 3, 6 and 7) that join front mount assembly 100 to crossbeam 20; and sensor 160 (shown in FIGS. 6 and 7) that senses and provides signals to control the depth of plow. Also shown in FIGS. 4,5,6 and 7 is front mount assembly 100 which attachs to the front of the AAV.

More specifically, float shoe assembly 40 contains two identical float shoes 41 and 42 that are arranged in a parallel configuration and are located forwardly and below cross beam 20. In operation, the float shoes 41 and 42 slide along virgin ground surface and provide support for positioning the mine clearing apparatus 10 relative to the ground surface which, in turn, controls the depth of plow.

Figure 2:
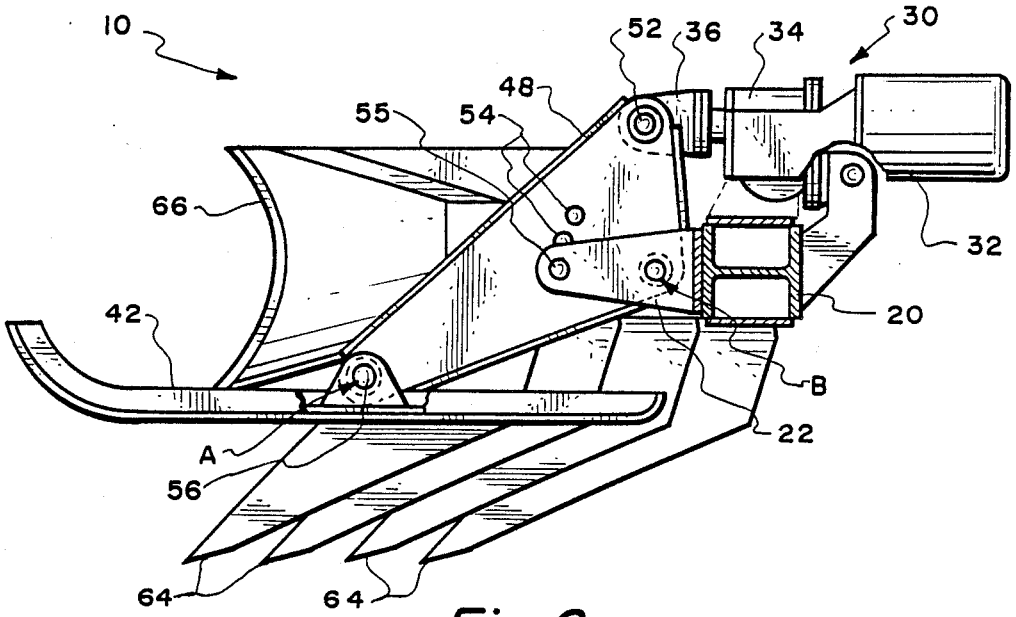
FIG. 2 is a cross sectional view of the mine plow assembly taken on line 2—2 of FIG. 1 and showing the depth adjuster assembly, float shoe assembly, plowing assembly and tines.

As can be seen in FIG. 2, float shoe 42 (41 is identical) is configured with the front and rear ends curved upwardly, the bottom surface flat and the sides extending above the bottom surface. This shape enhances the gliding effect of the shoe 42 and causes the shoe 42 to remain on top of the virgin ground surface and to continue to support the mine clearing apparatus 10 when plowing.

Float shoes 41 and 42 are linked to cross beam assembly 20 by arms 46 and 48 respectively. The arms 46 and 48 are fabricated in a "boxed" section and are triangular in shape. Each float shoe 41 and 42 is pivotally attached to one corner of its triangulated arm with each arm disposed between two parallel ears 56 located approximately in the center of the top surface of the float shoe, (see FIG. 2 point A for example). Likewise, arms 46 and 48 are pivotally attached to cross beam 20 (see FIG. 2 point B for example) and are each disposed between two parallel ears 22 located approximately equidistant from the center of cross beam 20. It should be noted that the pivotal attachments at points A and B of arms 46 and 48 can be of any type well known in the art such as a bushing or bearing over a shaft or bolt with a cotter key or nut to secure the fixture. In addition, collars may be positioned at the pivot points and between the sides of an arm 46 or 48 and permanently fixed by means, such as welding, to provide support against collapse or flexing of the arms 46 and 48 while in operation and to act as a bearing surface for inserted members.

Crossbeam assembly 20 is configured from a conventional "I" beam with plates welded across the open sides (see FIG. 1) to form a "boxed" circumferential cross section as shown in FIG. 2. Each end of assembly 20 is angled with an attached plate for accepting the mounting of plowing assemblies 60 and 80. Crossbeam 20 is preferably constructed from mild steel such as SAE 1018 for example.

Plowing assemblies 60 and 80 are shown in FIG. 1 attached, by bolts, directly to crossbeam 20 at the outer ends and attached by bolts to arms 62 and 82 at the inner ends. Each plowing assembly 60 and 80 contains respectively a plurality of vertically disposed horizontally spaced parallel plow tines 64 and 84 that communicate with the soil during plowing so that the tines 64 or 84 loosen the ground surface to a desired depth and dislodge and uplift mines that may be embedded therein.

The tines 64 and 84 are disposed in a spaced horizontal relationship so that the path plowed by the tines 64 and 84 is wider than the tread width of the AAV. It should be observed that the tines 64 and 84 are positioned directly in front of each vehicle tread and are adjacent and behind float shoes 41 and 42. It should also be noted that mines whose width is narrower than the horizontal tine spacing will be uprooted and swept aside due to the adhesive effect of the soil on the embedded mine.

As shown in FIG. 1 and FIG. 2, plowed soil and mines are swept aside by moldboards 66 and 86 located above and to the rear of tines 64 and 84. The cross sectional shape of the moldboards 66 and 86 is concave and extends from adjacent float shoe assembly 40 to beyond the edge of the outermost tines 64 and 84.

Depth adjuster assembly 30, shown in FIG. 1 and FIG. 2, includes motor 32, screw jack assembly 34 and movable clevis ram 36 all mounted to cross beam 20 (see FIG. 1 and FIG. 2). The motorized screw jack 34 can be operated from a remote location for example from inside an AAV. When a signal is applied, motor 32 drives screw jack 34 and causes ram 36 to move inwardly or outwardly.

The depth adjuster assembly 30 and float shoe assembly 40 work in conjunction to vary the plowing depth of the plow tines 66 and 86. Both float shoes 41 and 42 are raised or lowered in substantial unity through interconnecting pivoting pin 52 which extends from slightly beyond the outer surface of arm 46 to slightly beyond the outer surface of arm 48. At such outer extending ends, pin 52 may be secured for example by a cotter key inserted through holes located in each extending end of pin 52.

Pin 52 is acted upon by clevis ram 36 which is pivotally located over pin 52 and between the inner surfaces of arms 46 and 48. The operation of the float shoe assembly 10 to raise or lower the plow tines 64 and 84 can be appreciated with reference to FIG. 2. It will be noted that only the operation of float shoe 42 will be herein described but that in practice both float shoes 41 and 42 operate simultaneously. In operation, motor 32 of depth control assembly 30 can be controlled from a remote location such as from within the safety and protection of the AAV or by an automatic means. For example, when it is desired to raise the plow tines 64 and 84, motor 32 is operated in one direction to cause clevis ram 36 to act on arm 48 through pin 52. Arm 48 is then caused to pivot counterclockwise about point B. The pivoting motion of arm 48 forces float shoe 42 against the soil. The resultant reactive force is an uplifting force at point B which lifts cross beam 20 and plowing assemblies 60 and 80 attached thereto. As a result, the plow tines 64 and 84 are caused to be retracted from the soil. It can also be understood that operating motor 32 in the opposite direction will result in the plow tines 64 and 84 extending deeper into the soil.

Also shown in FIG. 2, are lock-up bores 54 of which three are formed in each arm 48 and 46 (FIG. 1). Bores 55 are formed in the end of each ear 22 to align with bores 54 such that a pin or bolt can be slidably placed through aligned bores 54 and 55 to rigidly fix float shoes 41 and 42 in place. Float shoes 41 and 42 can each be rigidly fixed in the same or different positions by selecting the appropriately aligned bore. In such case however pin 52 may require removal. In this way the mine clearing apparatus can continue to be operated when the depth adjuster assembly 30 has been disabled or removed or when it is desired to adapt the apparatus 10 to special use in uneven terrain for example or when transporting the apparatus 10 for safety and ease of handling.

Figure 4:
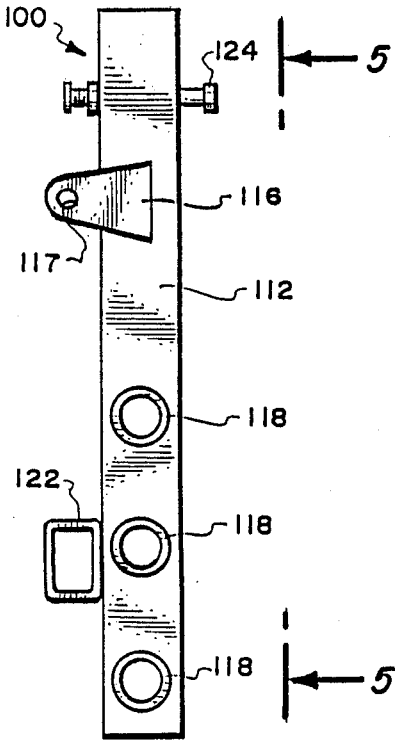
FIG. 4 is a side elevation view of a mount assembly for an AAV.
Figure 5:
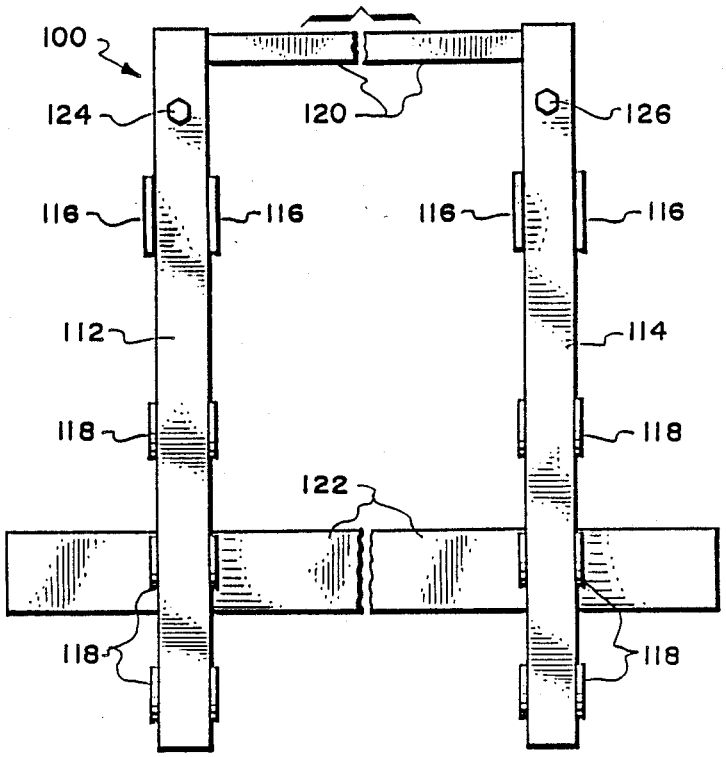
FIG. 5 is a front elevation view taken on line 5—5 of FIG. 4 of a mount assembly for an AAV.

Located on the front down sloping side of the AAV is front mount assembly 100 shown in FIG. 4 and FIG. 5 for attaching mine clearing apparatus 10 to the AAV. The mount assembly 100 is required to adapt to an existing AAV without requiring any hull penetrations or other vehicular modifications.

Mount assembly 100 includes parallel square tube members 112 and 114, each member 112 and 114 containing a parallel set of ears 116 attached for example by welding to the inner and outer surfaces of each member 112 and 114 (see FIG. 4 and FIG. 5). Each ear 116 has a bore 117 configured to align with bored mounts (not shown) that are located on the front surface of an AAV so that when aligned, retaining pins (not shown) can be slidably inserted to maintain the bores in aligned configuration.

Each member 112 and 114 also contains circular bushings 118 extending from slightly beyond the outer surface of one member 112 or 114 to slightly beyond the inner surface of the same member 112 or 114. The bushings 118 are fixably attached, for example, by welding and provide support against wall collapse and act as a bearing support surface and a pivoting location point for pushbars 138 and 139 FIG.3. As can be seen in FIG. 4 and FIG. 5, three sets of bushings 118 are provided so that the angle or heights of pushbars 138 and 139 can be varied as conditions require.

Square tubular member 120 shown in FIG. 5 and square tubular member 122 shown in FIG. 4 and FIG. 5 are also included as part of front mount assembly 100. Member 120 is located at the upper end of mount 100 and extends from the inside shoulder of member 112 to the inside shoulder of member 114 while member 122 extends beyond the outside shoulders of members 112 and 114 and is located away from the lower end of mount 100 as shown in FIG. 5. Members 120 and 122 are substantially parallel to each other and perpendicular to members 112 and 114. Members 112, 114, 120 and 122, ears 116 and bushings 118 are fabricated from low carbon steel such as SAE 1018 and all joints are fixed as by welding, for example. Located near the upper ends of member 112 and 114 are preload adjusters 124 and 126.

Figure 3:
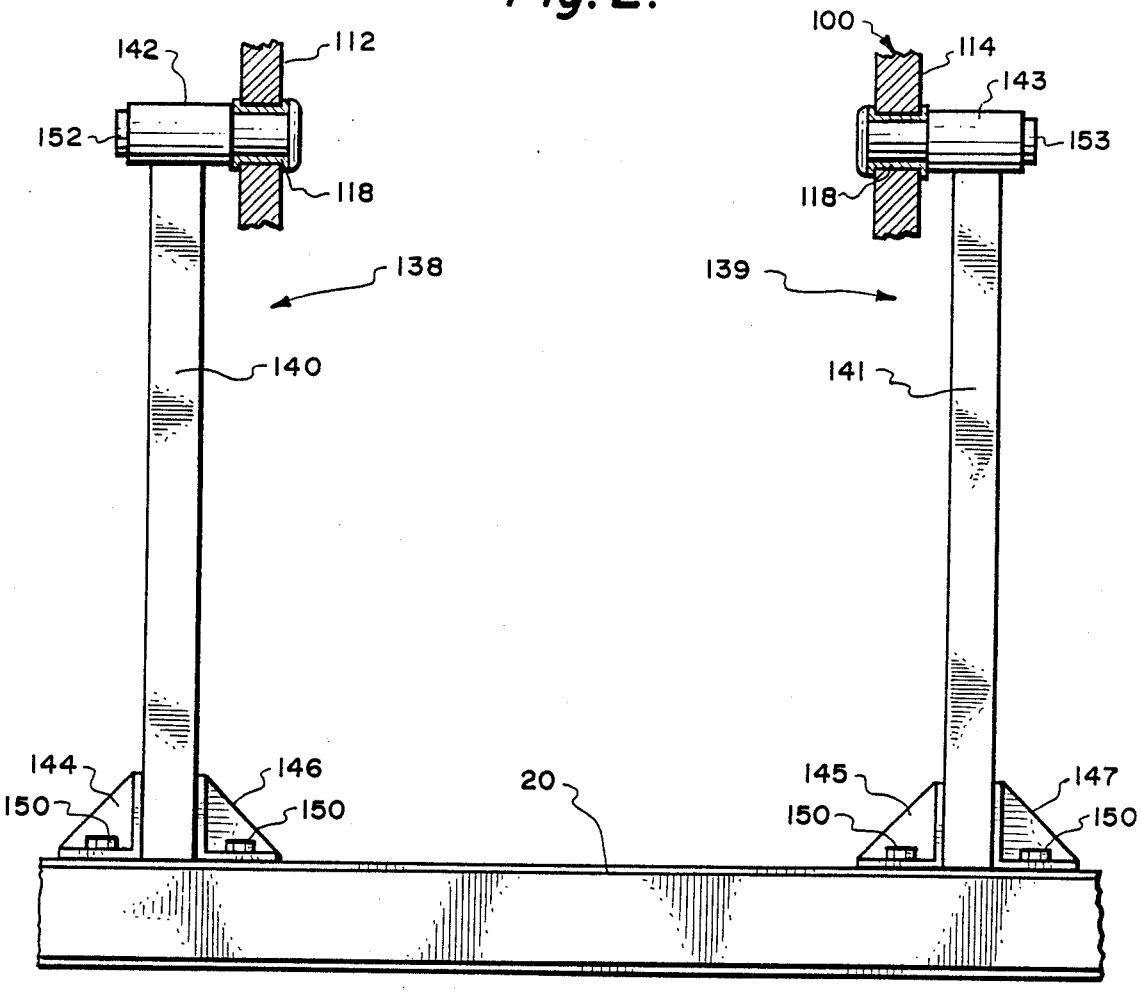
FIG. 3 is a top view of the pushbars that connect the mine clearing apparatus to a vehicle such as an assault amphibian vehicle (AAV).

FIG. 3 shows struts 140 and 141 that attach cross beam 20 to mount assembly 100. Circular collar 142 is attached to one end of strut 140 and "L" brackets 144 and 146 are attached to the other end of strut 140. Strut 141 is identical and contains collar 143 and "L" brackets 145 and 147.

"L" brackets 144, 145, 146 and 147 are attached to cross beam 20 by bolts 150 and collars 142 and 143 are pivotally attached to mount assembly 100 by pins 152 and 153 respectively. The angle of pushbars 138 and 139 can be varied by "pinning" collars 142 and 143 to any one of three alternate bushings 118, FIG. 4, located in mount 100. When assembled on the AAV, the axis through pins 152 and 153 is substantially parallel to the axis through cross beam 20.

Figure 7:
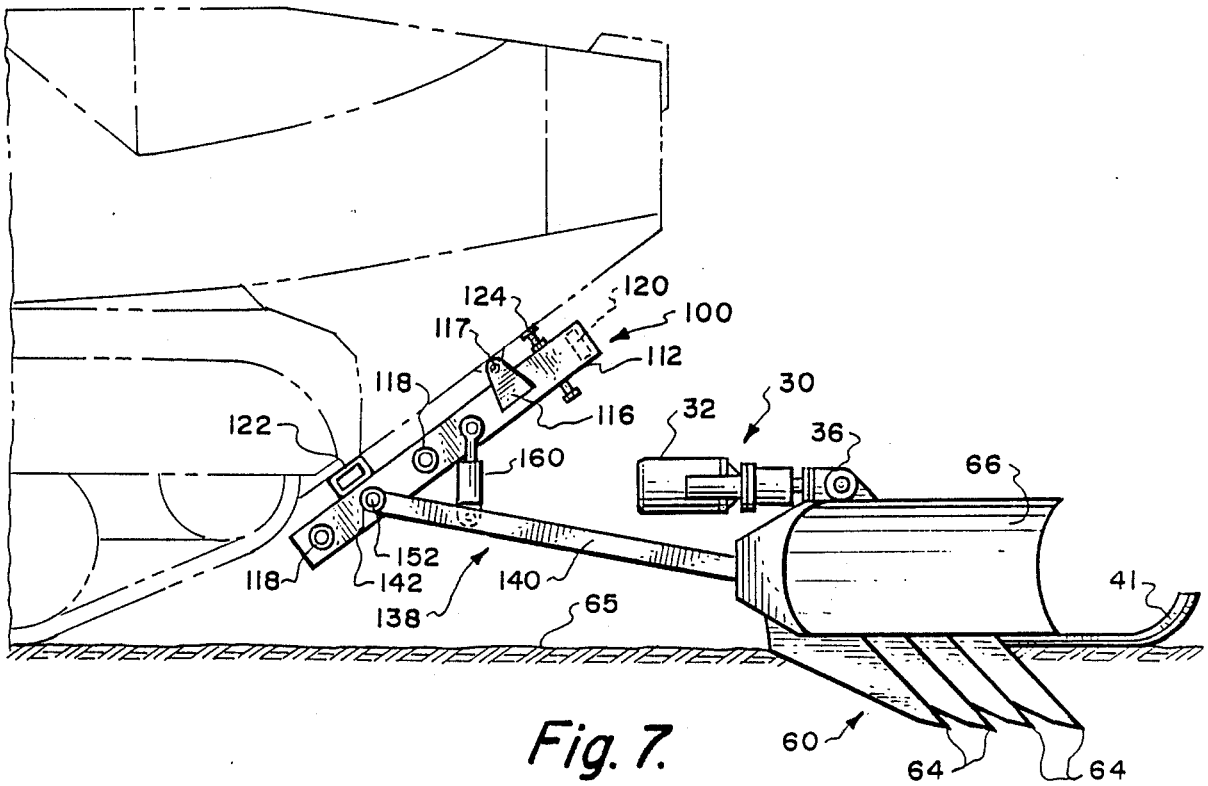
FIG. 7 is a side view of the mine clearing apparatus mounted to the front of an AAV and showing the pushbars and the mount assembly.
Figure 6:
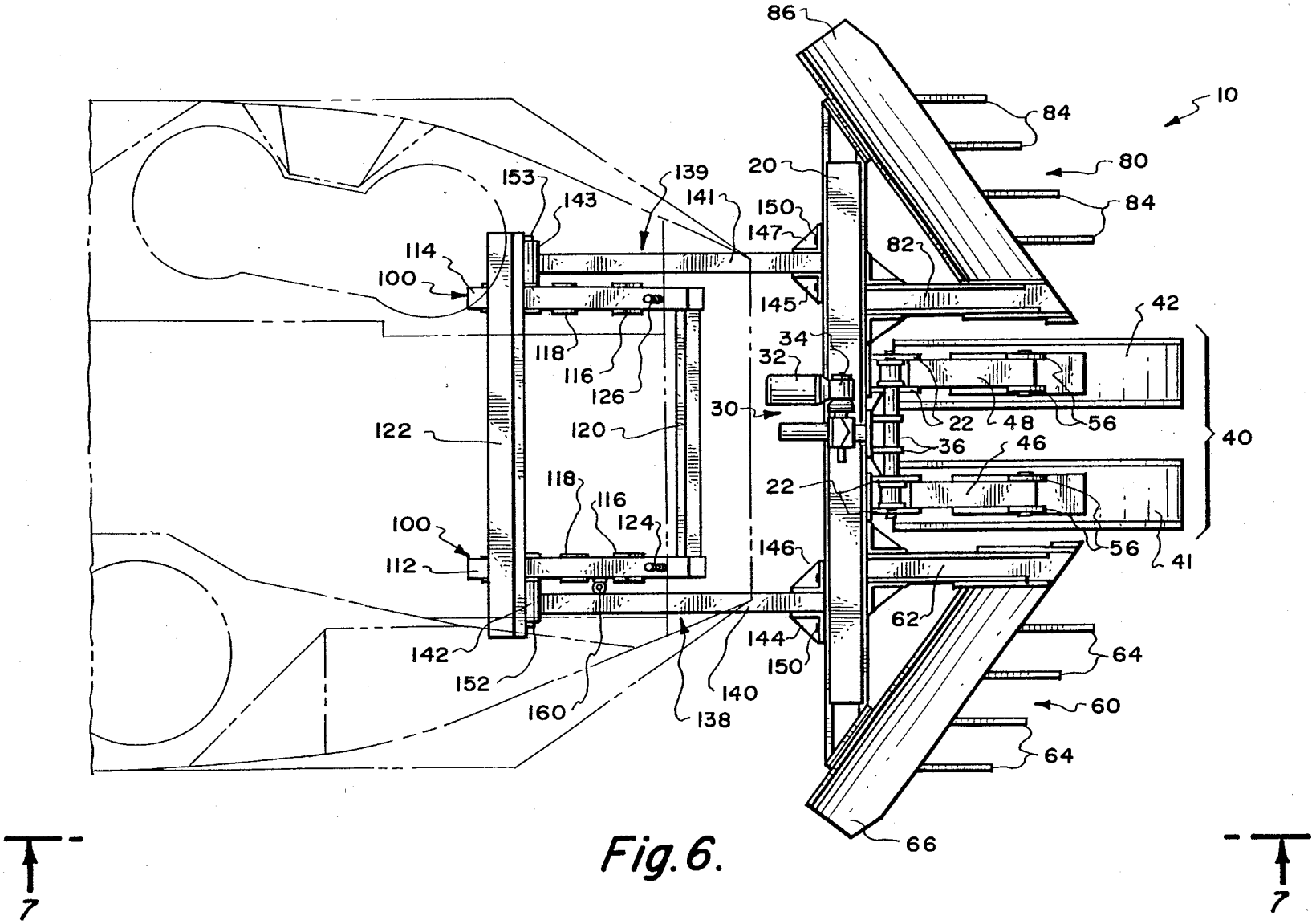
FIG. 6 is a top view of the mine clearing apparatus mounted to the front of an AAV and showing the pushbars and the mount assembly.

FIG. 6 and FIG. 7 show the mine clearing apparatus mounted on the front of an AAV plowing soil 65. It can be seen that the plowing force on the tines 64 and 84 tend to urge the entire plow mechanism deeper and deeper into the soil but that float shoes 41 and 42, being disposed on the virgin soil, provides resistive force to maintain the plow at a predetermined depth. Since the float shoes 41 and 42 are on virgin soil and not on plowed soil, the float shoe mechanism 40 will maintain the plow tines 64 and 84 at a chosen depth relative to the virgin soil unless the front of the vehicle raises which forces the tine tips to rotate deeper in the soil.

Sensor assembly 160, as shown in FIGS. 6 and 7, is positioned to communicate with pushbar 138 and front mount assembly 100 for example. The sensor can be of any conventional type that will provide control signals through conventional logic control circuitry. In operation, the sensor assembly 160 continually responds to changes in the relative angle between front mount assembly 100 and pushbar 138 and produces signals via the control circuitry to control the depth adjuster assembly 30 for raising or lowering plow tines 64 and 84 (not shown).

It will be appreciated by persons skilled in the art that the invention is not limited to what has been particularly shown and described hereinabove. Rather, the scope of the invention is defined only by the claims which follow.

We claim:

1. Mine clearing apparatus, comprising:

a mount attached to the front of a pushing vehicle and adapted for the selectable receiving of said mine clearing apparatus;

means for positioning of said mine clearing apparatus above the ground while plowing and adapted to slide on top of virgin soil;

a crossbeam for receiving said positioning means;

first and second pushbars pivotally connecting said crossbeam to said mount;

first and second plowing apparatus angularly attached to the ends of said crossbar and including a plurality of vertically disposed, parallel tines for engaging and uplifting soil and mines and further including moldboards for sweeping aside said uplifted soil and mines;

sensing means, communicating with said mine clearing apparatus and said pushing vehicle, for continuously monitoring the relative position of said mine clearing apparatus and said pushing vehicle and producing control signals for maintaining said mine clearing apparatus of a constant depth of plow when said pushing vehicle moves up or down in response to reactive forces generated when said mine clearing apparatus encounters uneven or variable load terrain;

adjusting means on said crossbeam and communicating with said positioning means, said adjusting means being able to respond to control signals from said sensing means and thereby control said positioning means.

2. The mine clearing apparatus of claim 1, wherein said adjusting means comprises a screw jack, a movable clevis and means for moving said screw jack.

3. The mine clearing apparatus of claim 2, wherein said moving means comprises a motor.

4. The mine clearing apparatus of claim 1, wherein:

said positioning means are located ahead of and between said first and second plowing apparatus and are movably connected to said crossbeam by pivoting arms that control the downward rotation of said mine clearing while plowing.

5. The mine clearing apparatus of claim 4, wherein: said adjusting means communicates with said positioning means via said pivoting arms and causes said arms and said positioning means to move.

6. The mine clearing apparatus of claim 4, wherein: said arms are triangular in shape with said positioning means pivotally attached to a first corner of each said arm, said crossbeam pivotally attached to a second corner of each said arm and said adjusted means pivotally attached to a third corner of each said arm.

* * * * *